US005678792A

United States Patent [19]

Arguin et al.

[11] Patent Number: 5,678,792

[45] Date of Patent: Oct. 21, 1997

[54] METHOD AND DEVICE FOR ATTACHING OBJECTS TO APPLIANCES

[76] Inventors: Donald G. Arguin, HCR 33, Box 221, Keene, N.H. 03431; Frederick A. Alibozek, 35 Birch Rd., Peterborough, N.H. 03458

[21] Appl. No.: 625,593

[22] Filed: Apr. 3, 1996

[51] Int. Cl.[6] ..... A47B 96/06; A47F 5/00; A47H 1/10; E04G 3/00

[52] U.S. Cl. ..... 248/205.1; 248/442.2

[58] Field of Search ..... 248/205.1, 205.2, 248/316.7, 442.2, 447.1, 918; 52/202, 222; 474/205, 237, 246, 250, 253, 254, 255

[56] References Cited

U.S. PATENT DOCUMENTS

| | | | |
|---|---|---|---|
| 375,308 | 12/1887 | Arnao, Jr. | 474/256 X |
| 2,704,302 | 3/1955 | Budd | 248/316.7 X |
| 3,279,620 | 10/1966 | Nesbitt | 248/205.1 X |
| 3,666,251 | 5/1972 | McMurtry et al. | 52/202 |
| 4,011,766 | 3/1977 | Waugh | 474/250 X |
| 4,437,849 | 3/1984 | Berg | 474/256 |
| 4,475,705 | 10/1984 | Henneberg et al. | 248/442.2 X |
| 4,596,540 | 6/1986 | F'Geppert | 474/253 |
| 4,619,429 | 10/1986 | Mazza | 248/442.2 X |
| 4,632,471 | 12/1986 | Visnapuu | 248/442.2 X |
| 4,661,088 | 4/1987 | Tangorra | 474/237 |
| 4,750,302 | 6/1988 | Bechtold | 52/200 X |
| 4,767,093 | 8/1988 | Jones | 248/442.2 |
| 4,861,322 | 8/1989 | Reddick | 474/255 X |
| 4,902,078 | 2/1990 | Judd | 248/442.2 X |
| 5,055,090 | 10/1991 | Miranti, Jr. | 474/250 X |
| 5,092,823 | 3/1992 | Longo | 474/253 |
| 5,104,087 | 4/1992 | Wentzloff et al. | 248/442.2 |
| 5,301,915 | 4/1994 | Bahniuk et al. | 248/442.2 X |
| 5,328,145 | 7/1994 | Charapich | 248/442.2 |
| 5,398,905 | 3/1995 | Hinson | 248/442.2 |
| 5,499,793 | 3/1996 | Salansky | 248/442.2 |
| 5,505,421 | 4/1996 | Marthaler | 248/442.2 |
| 5,509,534 | 4/1996 | Taravella et al. | 206/454 X |
| 5,533,702 | 7/1996 | Koch | 248/442.2 |

*Primary Examiner*—Leslie A. Braun
*Assistant Examiner*—Sandra Snapp
*Attorney, Agent, or Firm*—George W. Dishong

[57] ABSTRACT

The present invention is directed to an inexpensive display device and a method of attaching objects such as pictures, notes and the like to appliances. The invention is substantially a flexible, lengthwise deformable band which is extended around the perimeter of an appliance. The band is secured in place by the deformable material creating frictionous contact with the appliance. The objects are attached to the display device by inserting them into at least one channel cut length-wise into the band. A plurality of short channels may also be cut at a selected predetermined angle to the length-wise center-line of the band. The preferred angle being between about 30 and 90 degrees. The device may be configured as a continuous stretchable band or may be made having ends which are adjustably attachable each to the other. The objects are held in place in the channel by the material of the device creating frictionous contact with the objects.

15 Claims, 2 Drawing Sheets

METHOD AND DEVICE FOR ATTACHING OBJECTS TO APPLIANCES

BACKGROUND OF THE INVENTION

Field of the Invention

This invention most generally relates to a method of and a device or apparatus for use in attaching objects to the perimeter of an appliance.

More particularly this invention relates to an inexpensive, unobtrusive method of and a device or apparatus for use as a means for attaching small objects such as notes or pictures around the perimeter of an appliance such as, for example, a computer display monitor, television monitor, a microwave or the like. The invention allows the user to attach the objects without having to clip, staple, or tape or otherwise damagingly secure or attach the objects to either the appliance or a large, cumbersome attachment to the appliance, which when attached to the appliance may cause damage to the appliance.

Note and memo boards have long been used in a wide variety of ways around homes and offices. Most memo boards are fairly large and incorporate a variety of surfaces such that a user may either write on the board or tape or tack notes to the board.

With the development of computers, note boards have been adapted to fit on or around computer monitors to attach important instructions, reminders or other objects desired by the user. Note boards have also been adapted to fit on or around other appliances such as microwaves or telephones, However, due to the need for a relatively large, flat surface, note boards are rather cumbersome to attach to relatively small appliances such as those listed above. Thus, there were developed other ways of attaching objects to appliances such as the use of small POST-1T® notes which are convenient, but tend to lose their adhesive properties and fall off of the appliance to which it is attached.

There have also been large devices which clamp around, for example a computer monitor, and which hold carriages or panels for whole sheets of paper in order that the user may copy material from the paper and enter it into the computer. These devices are convenient for large sheets of paper, but not for small reminders or pictures. In addition most of the current devices are cumbersome, and not easily installed and removed.

To date there has not been developed any small, unobtrusive, inexpensive, easily installed device to hold notes, reminders, photographs or other objects without having to write on the device or stick the note to the device with either a tack, or some adhesive such as tape. The method and device of the present invention is simpler and less permanent than previous devices, including those devices indicating that they are removable. Adhesive tape, screws, or even VELCRO® brand of fastener with tape, can be difficult to align and install as well as invariably leaving permanent installation marks. For those devices requiring adhesive, fresh adhesive is needed with reinstallation. The present invention, in all embodiments, is easier to install and less damaging to the appliance to which it is being mounted.

DESCRIPTION OF THE PRIOR ART

Eight patents were reviewed as part of the prior art. The seven United States Patents reviewed were U.S. Pat. Nos.; 4,869,565 to Bachman, 5,104,087 to Wentzloff et al., 3,817,486 to Liljequist, 5,292,099 to Isham etal, 5,301,915 to Bahniuket al., 4,456,315 to Markley et al., and 5,398,905 to Hinson and one British Pat. No. 736,328 to McGloin.

The U.S. Pat. No. 4,869,565 discloses a display apparatus which is affixed to the sides and top of a computer monitor. The specification and claims are directed specifically to computer monitors only. The device consists of what they call "longitudinal channel members" and "display members". The channel members are material adhesively bonded to the two vertical sides of the monitor and to the top. They contain channels into which are inserted panels which are the display members on which notes are attache& The channel members are three separate, non-contiguous pieces which must be aligned and the channels are designed to hold large L-shaped display members that extend up the sides of the monitor and across the top. Any notes are attached to the display members, not inserted into the channels themselves. The device is expandable to fit different sized monitors, but the adjustment is accomplished by sliding the display panels in the channels, not by adjusting the channel containing members. Moving the channel containing members to another appliance or removal and reinstallation to the same appliance requires fresh tape and realignment of the members.

The British patent No. 736,328 discloses "supports for show cards". The device is a block of resilient, manually deformable material with a slit in which an edge of a "show card" or other similar material is held by compression between the opposite faces of the slit. The holding device is quite different from the instant invention. The device of the British patent is not designed to fit around an appliance nor is it made to be attached around the perimeter of an object by lengthwise deformation of a continuous device. It is designed to be stuck to a store window or shelf, or in another design, to be attached to a rod such as a flag pole or bicycle frame.

U.S. Pat. No. 5,104,087 discloses a memo or note board constructed to be associated with an "information display device". The board is substantially U-shaped and fits around a monitor for example. The device is held in place by strips of VELCRO® brand of fastener with tape by a strip on the monitor, and a matching strip on the device, and adjusted in place with a series of brackets, making installation or relocation seemingly cumbersome and time consuming. The board can be of a material suitable for sticking tacks into to hold notes, or may be made of a material which can be written on and erased, or can be part of two different materials for two .different purposes. There are no channels for insertion of paper, and the device is not one piece, although it is directed to be used with appliances other than computer monitors.

U.S. Pat. No. 3,817,486 is directed to a holder for notes, messages, and business cards, etc. The invention is a device designed to hold paperclips or other standard form wire holders. The device consists of a base which can be attached to a telephone, wall or dashboard of a vehicle, and channels to hold the wire paper holders in place. There are channels or slots in the device to receive the wire paper holder, but the paper is not held directly by the device. This device is also mounted with the use of adhesive tape.

U.S. Pat. No. 5,292,099 discloses a display mounted document holder designed to clamp to a display monitor. The device is substantially U-shaped and fits clamped over the top and down the sides of, for example, a computer monitor. Attached to the vertical sides of the U-shaped piece are a series of "slideways" designed to receive arms attached to document platens or holders. Thus, various sized and shaped holders can be attached to the U-shaped piece by inserting arms attached to the document holders into the slideways. The arms designed to hold the platens may have hinges such that the platen or holder may be swung out of the way, and flush with the side of the monitor. The base U-shaped piece can be adjusted to fit over differently sized display monitors. However the device is not one piece and the device itself does not hold the documents. Also, the device is rather large, and designed to hold materials such as full sheets of paper as opposed to a multitude of smaller sheets.

The U.S. Pat. No. 5,301,915 describes a note holder board. The board is designed to have notes clipped or stuck to it. The boards held in place on either the top or side of a display monitor by a "support means" which is attached to the monitor with either VELCRO® brand of fastener or with double-sided tape. The concept of holding smaller notes with this invention is disclosed. The notes are stuck to a large board, and not inserted into channels. In order for the notes to remain on this device they must be clipped or stuck by some adhesive.

U.S. Pat. No. 4,456,315 is directed to a device for protecting a computer or business machine monitor from damage due to use and abuse. A flexible, resilient band extends around the perimeter of the appliance, however there is no provision or intention for this device to be able to hold anything. It is simply designed to protect the monitor from damage from being bumped.

Finally, U.S. Pat. No. 5,398,905 describes a die-cut display board for a computerized display screen. The device is designed to fit around the face of a computer monitor such that it is flush with the screen. The device is made of one piece. The middle region, where the screen would be is scored such that the middle may be pushed apart creating tabs to be folded in towards the backside of the device to lie on the top and sides of the monitor to form the opening for the screen. The tabs are then fastened to the monitor to secure the device to the monitor. The device can also have a holder attached for holding writing instruments, and can be shaped in any number of novelty designs such as a football or baseball. The device is meant to hold small notes or similar items, however, as with the U.S. Pat. No. 5,301,915 to Bahniuk et al, the materials must be clamped or stuck to the board with adhesive.

SUMMARY OF THE INVENTION

The present invention provides a display device and method for securely but removably attaching objects such as for example notes and photographs to appliances. The present invention is simpler and less permanently attached to the appliance than previous devices, including those devices indicating that they are removeable. A preferred embodiment of the present invention is a band comprising a continuous piece of resilient, flexible, lengthwise-deformable material sized in various sizes to fit around differently sized appliances, along the length of which may run one or more channels or slots. Alternatively, a plurality of slots may be oriented cross-wise to the band at any predetermined angle the preferred being from about 30° to about 90°. The material of which the display device of the present invention is made may be any lengthwise deformable material such as, but not limited to; latex, silicone, urethane or other elastomers or synthetic materials which preferably have about 500–700% elasticity and which preferably do not have any type of internal cords or fibers. The desired objects to be displayed are inserted into the channel at whatever location the User desires. The resilient, flexible nature of the device is such that the material of the device forming the channel securely holds in place the objects inserted into the channel. The dimensions of the display device vary so as to fit different appliances and permit the attachment of different objects thereto. Once installed on an appliance the display device will not slide or rotate out of position unless sufficient force is used to deform and remove the device from the appliance.

The invention could also be made from a band of resilient, flexible material that is not continuous, but has an opening at one point There would be two ends which would be adjustably attachable creating thereby a continuous device when attached around the periphery of an appliance. For example, each end might have attached matching potions of VELCRO® brand of hook and loop fastener. The embodiment of the device having two adjustably connectable ends may also be lengthwise deformable which deformation amount will effect the level of frictionous contact to the appliance, thus securing the device in place on the appliance. The device could be size adjusted more easily to fit the appliance on which the device were being installed if the device were able to be opened. The device is easily removeable and transferrable to other appliances in very little time.

The device has a cross section such that objects, when attached to the device, are facing the viewer or user of the appliance. However, the display device of the present invention could also be mounted around the perimeter of a table or vertically along, for example, a wall, such that the desired objects may be displayed in a variety of orientations. The device could also be mounted such that it extends over the base of objects displayed on an appliance in order to hold the objects in place on the surface of the appliance.

The surface of the device which contacts the appliance, when the device is placed on the appliance, may be configured to provide substantial contact area and be surfaced to provide frictionous contact.

The base material into which the channel or channels are cut or otherwise formed, may also have different configurations, such as feet, to raise the main display part of the device off of the surface of the appliance to which it is attached, to enhance the securing of the device to the appliance, or to better position and secure the displayed objects for viewing depending on the angle of the surface of the appliance to which the device is attached. The base of the device may also contain a depression which aids the hand of the user such that the channel may be opened more easily to facilitate insertion of the desired objects.

In other embodiments, the size and shape of the channel may be such that different objects may be used in the device, from pieces of paper or photographs to standard production picture frames. There may also be multiple channels for insertion of a greater number and variety of objects.

It would be advantageous to provide a method and display device which has the following advantages: easy to attach and remove from the appliance; easily and inexpensively manufactured; very unobtrusive and almost unnoticeable if no objects are attached to the device; inexpensive method and display device for attaching notes photographs and other objects of personal value to appliances which objects are easily installed and removed from an appliance; easily adjusted to fit differently sized appliances; may provide a continuous display device to which objects are attached directly without adhesives, tacks or special panels, arms or other tooling; easily accessible and convenient to the user, for attachment and removal of objects; and does not interfere with the use of the appliance.

It is still another object of the invention to provide a display device having all of the above advantages but which may be opened or disconnectable at one point in order to facilitate installation and removal of the device from appliances.

Yet still another object of the invention is to provide a display device for attaching objects to appliances comprising a flexible, lengthwise deformable band having a base portion; and at least one length-wise running channel cut in the lengthwise deformable band. Alternatively, a plurality of width-wise running channels may be cut in the lengthwise deformable band at an angle to a length-wise running centerline, the angled channels angled between at a preselected angle but preferably between about 30° and about 90° to the lengthwise centerline.

These and further objects of the present invention will become apparent to those skilled in the art to which this invention pertains after a study of the present disclosure of the invention.

DESCRIPTION OF THE PREFERRED EMBODIMENTS

The present invention is directed to an inexpensive display device and a method of attaching objects such as pictures, notes and the like to appliances. The invention is substantially a flexible, lengthwise deformable band which is extended around the perimeter of an appliance. The band is secured in place by the deformable material creating frictionous contact with the appliance. The objects are attached to the display device by inserting them into at least one channel cut length-wise into the band. A plurality of short channels may also be cut or formed substantially orthogonal to the length-wise center-line of the band. The device may be as a continuous stretchable band or may be made having ends which are adjustably attachable each to the other. The objects are held in place in the channel by the material of the device creating frictionous contact with the objects.

Figure 1:
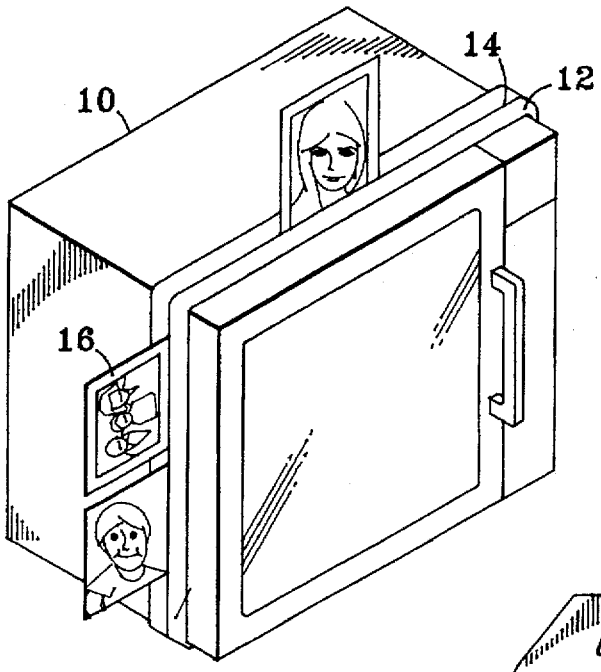
FIG. 1 is a perspective view of the display device showing the invention installed on an appliance with objects attached to the appliance.

Referring now in detail to the drawings, wherein similar reference numerals denote similar elements throughout the drawings, the present invention, as shown in FIG 1 provides the display device 12 installed around the perimeter of an appliance 10 objects such as photographs 16 are shown inserted into a channel 14 in display device 12. Display device 12 may be manufactured by extruding, molding, casting, general machining or various other forming methods. Display device 12 may also be manufactured in separate pieces such as a base portion and a channeled portion which separate pieces may be subsequently removably or more permanently attached each to the other prior to or subsequent to making attachment of the device to an appliance such as a PC monitor. If the device is made from multiple pieces the pieces may be removably attached or more permanently attached such as by fitting or bonding each piece appropriately positioned next to or on top of each other.

Figure 2D:
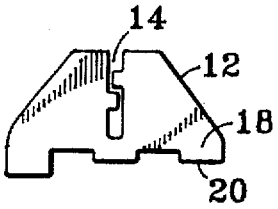
FIGS. 2 thorugh 2J each show various configurations of the channel and the base portion of the display device.
Figure 2E:
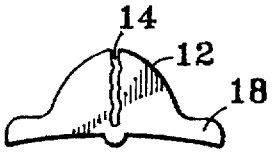
Figure 2F:
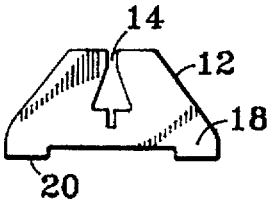
Figure 2:
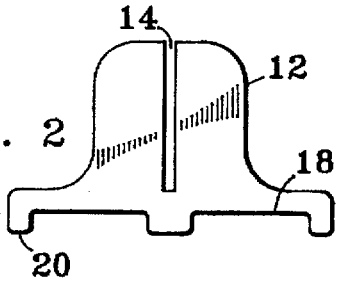
Figure 2G:
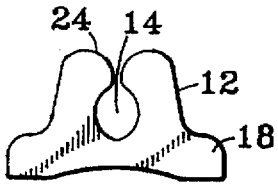
Figure 2H:
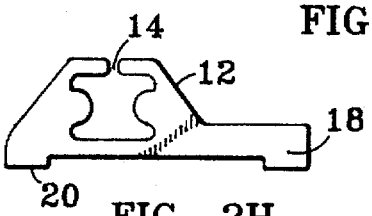
Figure 2A:
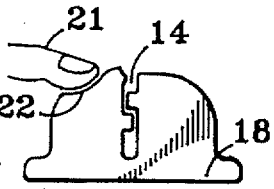
Figure 2B:
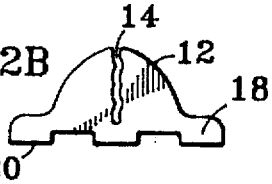
Figure 2I:
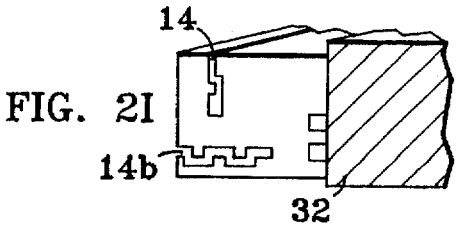
Figure 2C:
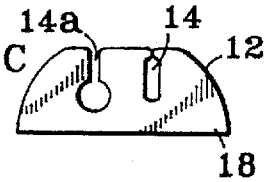
Figure 2J:
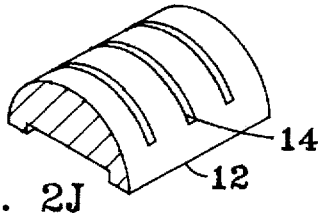

As shown in FIGS. 2–2J, display device 12 may have a base portion 18 which may be flat or be formed with feet 20. Channel 14 may be formed in various sizes and shapes to accomodate various objects. Channel 14 may extend or be cut to form a continuous channel throughout the length of display device 12 or may be formed to several non-continuous channels.

FIG. 2A shows an indentation feature 22 such that a finger 21 may be placed into indentation 22 to facilitate opening of channel 14 for insertion of an object.

FIG. 2B shows feet 20 formed in base portion 18 to allow for better positioning of display device 12 on irregular or non-flat surfaces.

FIG. 2C depicts multiple channels 14 and **14*a* of various sizes and depths to add to the range and number of objects able to be held by display device 12**.

FIG. 2D illustrates how feet 20 may be of varying height to apply additional frictionous contact to an appliance, to conform to appliances with angled surfaces, or to orient the displayed object at a forward or backward angle.

FIG. 2E illustrates how base portion 18 may be formed to add additional pressure to the object being held.

FIG. 2F shows that channel 14 may be formed with changing width to accommodate objects of various thickness, by varying the depth to which an object is inserted into channel 14.

FIG. 2G illustrates a tapered entrance portion 24 of channel 14 formed to facilitate entrance of objects into channel 14.

FIG. 2H illustrates that base portion 18 may be asymmetrical in order to allow objects to be presented in a forward or rearward manner while still providing frictionous contact distributed over a wider area of an appliance FIG. 2I shows an embodiment of the invention wherein the display device 12 is mounted to a horizontally planar surface. This figure also demonstrates multiple channels 14 and **14*b* oriented perpendicular (but could otherwise be at various other combinations of angles) to each other such that objects may be inserted and displayed in a variety of orientations simultaneously. For example, display device 12 could be placed around a table top 32 where playing cards could be inserted into channels 14 or 14*b***.

FIG. 2J illustrates an embodiment of the invention wherein channels 14 are non-continuous and do not run lengthwise throughout display device 12.

Figure 3:
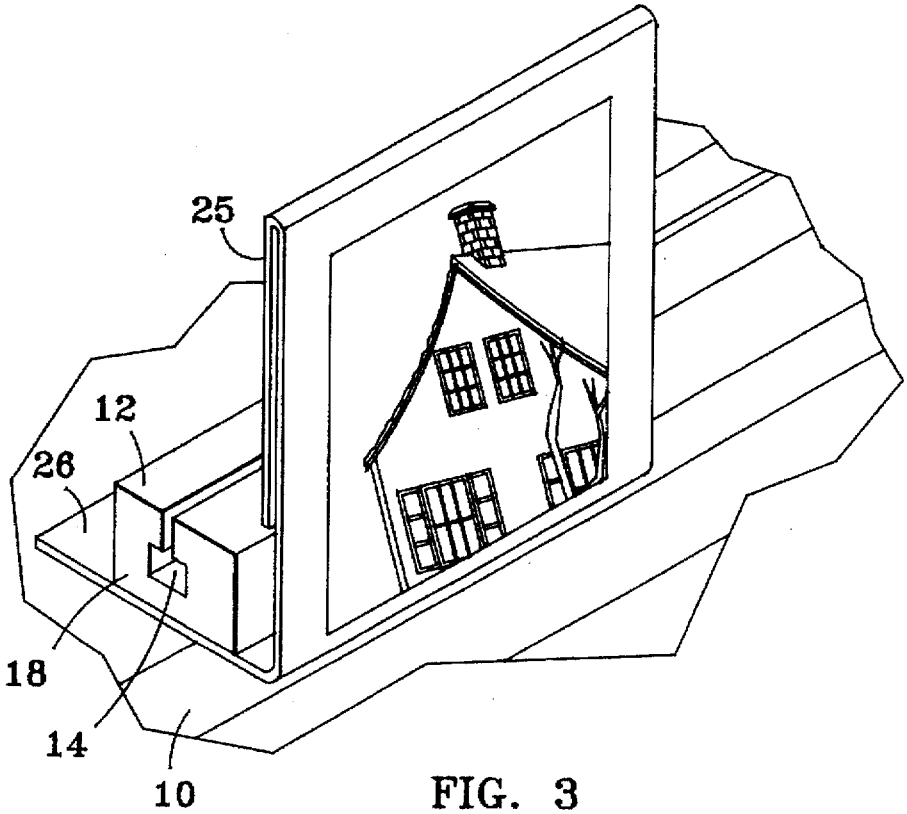
FIG. 3 is a perspective view of the display device showing how the frictionous contact of the display device with the appliance is used to secure objects to appliances in a manner other than by inserting the object into the channel in the display device.

In FIG. 3 it is shown that display device 12 may be used to secure objects such as an L-shaped picture frame 25 with base 26, to appliances, by way of the display device frictionous contact with the surface of appliance 10.

Figure 4:
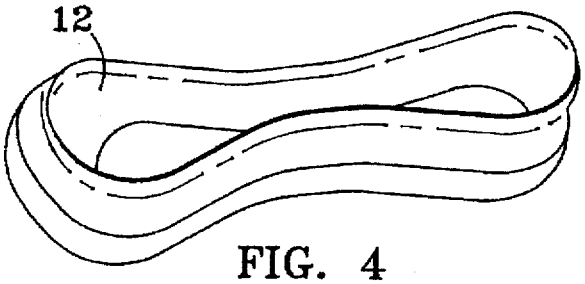
FIG. 4 is a perspective view of the continuous band embodiment of the display device.

FIG. 4 shows an embodiment of display device 12 which is formed from a continuous piece of material.

Figure 5:
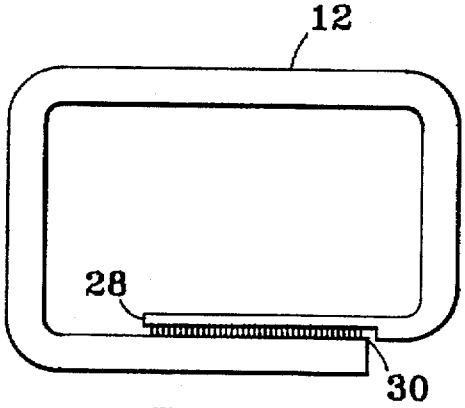
FIG. 5 is a plan view showing the non-continuous band embodiment of the display device with the two ends attached.

FIG. 5 in comparison shows an embodiment of display device 12 which is formed with two ends 28 and 30 which are adjustably and removably attachable by means of, for example VELCRO® brand hook and loop fastener.

Additionally, display device 12 may be manufactured in various colon to coordinate with the surroundings and appliances on which display device 12 is used. Display device 12 may also be manufactured to display a name or logo on a surface of display device 12 facing the viewer or the user of an appliance.

It is thought that the present invention, the method and the display device for attaching objects or articles to appliances, and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A method for attaching at least one object to appliances comprising:

installing a flexible, length-wise deformable band around the perimeter of said appliance;

deforming said band to open at least one length-wise running channel formed into said band;

inserting an edge of each said object into one of said at least one lengthwise running channel in said band; and securing each said object in said channel by releasing said band and allowing said band to reform to its original shape, thereby closing said one channel around said edge of said object.

2. The method according to claim 1 wherein said band is comprised of a continuous piece of flexible, lengthwise deformable material which is stretched around said perimeter of said appliance creating frictionous contact with said appliance.

3. The method according to claim 2 wherein said flexible, lengthwise deformable material is chosen from the group consisting of: latex rubber, silicone, elastomers, stretchable synthetics and urethane.

4. The method according to claim 1 wherein said band is comprised of a non-continuous piece of flexible, lengthwise deformable material having two ends, said two ends adjustably and removably connectable each to the other.

5. The method according to claim 4 wherein said two ends are adjustably attachable thereby creating a continuous display device frictionously contacting said appliance when attached around said perimeter of said appliance, thereby securing said band in place on said appliance.

6. The method according to claim 1 wherein said installing is accomplished by deforming said band lengthwise and sliding said band around said perimeter of said appliance creating frictionous contact with said appliance, thereby securing said band in place on said appliance.

7. The method according to claim 5 wherein said installing is accomplished by deforming said band lengthwise around the perimeter of said appliance, pulling said band until taut, and attaching said two ends to each other, thereby creating frictionous contact with said appliance securing said band in place on said appliance.

8. A display device for attaching objects to an appliance comprising:

a flexible, lengthwise deformable band comprising a base portion and a channeled portion; and at least one length-wise running channel cut in said channeled portion of said band wherein said band is comprised of a continuous piece of flexible, lengthwise deformable material which is stretchable around the perimeter of said appliance creating frictionous contact between said base portion of said band and said appliance, thereby securing said band in place on said appliance.

9. The display device according to claim 8 wherein said flexible, lengthwise deformable material is chosen from the group consisting of: latex rubber, silicone, elastomers, stretchable synthetics and urethane.

10. The display device according to claim 8, wherein said band is comprised of a non-continuous piece of flexible, lengthwise deformable material having two ends, said two ends adjustably and removably connectable each to the other.

11. The display device according to claim 10 wherein said two ends are adjustably connectable thereby creating a continuous display device frictionously contacting said appliance when attached around the perimeter of said appliance, thereby securing said band in place on said appliance.

12. A display device for attaching objects to appliances comprising;

a flexible, lengthwise deformable band comprising a base portion and a channeled portion; and a plurality of width-wise running channels cut in said channeled portion of said band at a predetermined and selected angle to a length-wise running centerline, wherein said band is comprised of a continuous piece of flexible, lengthwise deformable material which is stretchable around the perimeter of said appliance creating frictionous contact between said base portion of said band and said appliance.

13. The display device according to claim 12 wherein said material is selected from the group consisting of: latex rubber, silicone, elastomers, stretchable synthetics and urethane.

14. The display device according to claim 12 wherein said band is comprised of a non-continuous piece of flexible, lengthwise deformable material having two ends, said two ends adjustably and removably connectable each to the other.

15. The display device according to claim 14 wherein said two ends are adjustably connectable, creating a continuous display device frictionously contacting said appliance when attached around the perimeter of said appliance, thereby securing said band in place on said appliance.

* * * * *